US010633872B2

(12) United States Patent
Kreller

(10) Patent No.: US 10,633,872 B2
(45) Date of Patent: Apr. 28, 2020

(54) FRAMEWORK PLATFORM ELEMENT, IN PARTICULAR FOR SCAFFOLDING

(71) Applicant: Wilhelm Layher Verwaltungs GMBH, Güglingen-Eibensbach (DE)

(72) Inventor: Helmut Kreller, Bad Rappenau (DE)

(73) Assignee: Wilhelm Layher Verwaltungs GmbH, Güglingen-Eibensbach (DE)

( * ) Notice: Subject to any disclaimer, the term of this patent is extended or adjusted under 35 U.S.C. 154(b) by 0 days.

(21) Appl. No.: 15/578,050

(22) PCT Filed: May 20, 2016

(86) PCT No.: PCT/EP2016/061444
§ 371 (c)(1),
(2) Date: Nov. 29, 2017

(87) PCT Pub. No.: WO2016/193023
PCT Pub. Date: Dec. 8, 2016

(65) Prior Publication Data

US 2018/0142479 A1 May 24, 2018

(30) Foreign Application Priority Data

Jun. 1, 2015 (DE) ..... 10 2015 108 650

(51) Int. Cl.
*E04G 1/20* (2006.01)
*E04G 1/15* (2006.01)
*E04G 5/14* (2006.01)

(52) U.S. Cl.
CPC ..... *E04G 1/152* (2013.01); *E04G 1/20* (2013.01); *E04G 5/14* (2013.01); *E04G 2001/156* (2013.01)

(58) Field of Classification Search
CPC ..... E04G 1/152; E04G 1/20; E04G 2001/156; E04G 5/14
See application file for complete search history.

(56) References Cited

U.S. PATENT DOCUMENTS 4,331,218 A * 5/1982 Layher ..... E04G 1/152 182/119
6,105,723 A * 8/2000 D'Alessio ..... E04G 1/152 182/119

FOREIGN PATENT DOCUMENTS

DE 7912134 4/1992
DE 9413722 U1 * 11/1994 ..... E04G 1/152
(Continued)

OTHER PUBLICATIONS

Kalpakjian: "Manufacturing Processes for Engineering Materials", Dec. 30, 2008.

(Continued)

*Primary Examiner* — Alvin C Chin-Shue
(74) *Attorney, Agent, or Firm* — Rankin, Hill & Clark LLP

(57) ABSTRACT

A framework platform element, in particular for scaffolding, includes a framework platform body made from sheet metal material and extending in a longitudinal direction, with a stepping surface region providing a stepping surface on a top side and with side panel regions connecting to the stepping surface region in transition regions, formed by shaping the sheet metal material in two edge regions of the stepping surface region and situated at a distance from one another in a transverse direction. At least one side panel region has an end profile region, formed by shaping the sheet metal material, in an end region spaced apart from the transition region in a vertical direction, wherein in at least one transition region and/or in at least one end profile region, at least one curved shaped region is provided. A radius of curvature is less than or equal to a material thickness of the sheet metal material in at least sections in at least one curved shaped region.

15 Claims, 4 Drawing Sheets

(56) References Cited

FOREIGN PATENT DOCUMENTS

Figure 1:
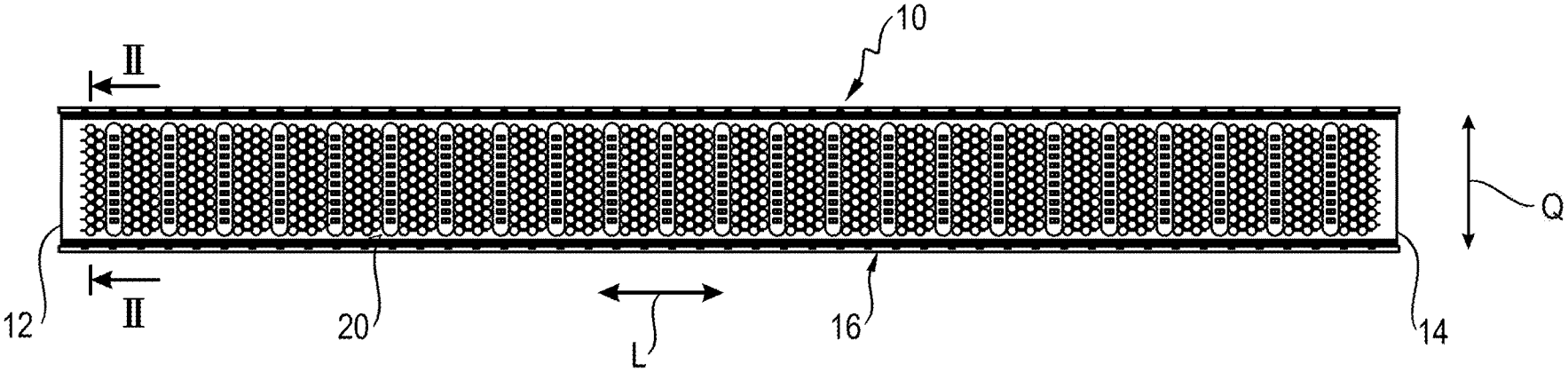

| | | | | | |
|---|---|---|---|---|---|
| DE | 19515062 | A1 | * | 10/1996 | ..... E04G 1/152 |
| DE | 29703879 | U1 | * | 5/1997 | ..... E04G 1/152 |
| DE | 19858969 | A1 | * | 6/2000 | ..... B23K 9/0026 |
| DE | 10012685 | A1 | * | 10/2001 | ..... E04C 2/3405 |
| DE | 10254033 | A1 | * | 6/2004 | ..... E04G 1/15 |
| EP | 0675244 | A1 | * | 10/1995 | ..... E04G 1/152 |
| EP | 1669515 | | | 6/2006 | |
| EP | 2354374 | A2 | * | 8/2011 | ..... E04G 1/152 |
| FR | 2690188 | A1 | * | 10/1993 | ..... E04G 1/152 |

OTHER PUBLICATIONS

International Search Report filed in PCT/EP2016/061444 dated Aug. 12, 2016.

* cited by examiner

FRAMEWORK PLATFORM ELEMENT, IN PARTICULAR FOR SCAFFOLDING

The present invention relates to a framework platform element, which is used, for example, for constructing scaffolding. A framework platform element of this type, designed generally as plank like, is elongate in a longitudinal direction and may be connected to the transverse supports or transverse spars of a framework or hung thereon in its two end regions, designed for example with hook-like connection elements or with connection openings. Depending on the width of the framework to be constructed, multiple framework platform elements of this type may be provided adjacent to one another in a transverse direction of the framework platform element. Framework platform elements of this type are generally constructed from sheet metal material and are formed by shaping a sheet metal blank which is stamped out or separated out of a metal sheet in any other way.

It is the object of the present invention to provide a framework platform element, in particular for scaffolding, which has a high load-bearing capacity and resistance to deformation in a lightweight configuration.

According to the invention, this problem is solved by a framework platform element, in particular for scaffolding, comprising a framework platform body composed of sheet metal material which is elongate in a longitudinal direction and which has a stepping surface region providing a stepping surface on a top side and with side panel regions connecting to the stepping surface region in transition regions formed by shaping the sheet metal material on two side edge regions of the stepping surface region spaced apart from one another in a transverse direction, wherein at least one side panel regions has an end profile region, formed by shaping the sheet metal material, in its end region spaced apart from the transition region in a vertical direction, wherein at least one curved shaped region is provided in at least one transition region and/or in at least one end profile region, characterized in that a radius of curvature is less than or equal to a material thickness of the sheet metal material at least in sections in at least one curved shaped region.

By shaping a sheet metal blank with very small radii of curvature, thus, in particular, radii of curvature whose size lies in the range of or below the material thickness of the sheet metal material, a significant stiffening is achieved by offsets in the lattice structure of the metal generated during the shaping of the sheet metal material, thus a metal material. This makes it possible to use a comparatively thin sheet metal material to construct a framework platform element according to the invention, since at a decreasing thickness of the sheet metal material, the radius of curvature is also reduced in at least one curved shaped region, thus a large deformation of the sheet metal material is generated.

In the embodiment according to the invention of a framework platform element, this may be provided, for example, at a material thickness in the range from 1.0 to 1.5 mm, preferably approximately 1.3 mm, based on the comparatively large deformation of the sheet metal material.

In order to guarantee that the framework platform element according to the invention has a sufficient deformation stability in all longitudinal areas, it may additionally be provided that at least one, preferably every curved shaped region extends in the longitudinal direction preferably uninterrupted essentially across the entire length of the framework platform body.

To additionally increase the stability of the framework platform element according to the invention, it may be provided that in at least one, preferably every, transition region, a plurality of, preferably at least three rib-like formations are provided, wherein at least one, preferably each rib-like formation comprises at least one, preferably a plurality of curved shaped regions.

To be able to provide contact surfaces in at least one of the transition regions, for example, for applying clamping straps holding multiple framework platform elements to one another, and thereby to avoid point or linear loads, it is additionally proposed that at least one rib-like formation comprises two curved shaped regions separated from one another by an essentially uncurved connecting region.

Another stiffening of a framework platform element according to the invention may be achieved by another advantageous aspect in that a rib-like formation, which has at least one curved shaped region and which extends preferably uninterrupted essentially across the entire length of the framework platform body, is provided in at least one, preferably in every side panel region between the transition region and the profile end region. This may also satisfy the previously mentioned relationship between the radius of curvature and the material thickness of the sheet metal material.

According to one particularly advantageous aspect, which is combinable in connection with the previously mentioned features, however, may also be implemented alone in a framework platform element, it is proposed that the profile end region comprises in at least one, preferably in every side panel region, a first profile transverse region, extending from one side panel extending essentially in a vertical direction to the other side panel region, and a second profile transverse region extending from the profile transition region to the side panel and connected to the first profile transverse region by a profile transition region, wherein a distance of the first profile transverse region to the second profile transverse region is smaller in the vertical direction that an extension length of the first profile transverse region and/or an extension length of the second profile transverse region in the transverse direction, and/or wherein a dimension of the profile end region is greater in the transverse direction than a dimension of the profile end region in the vertical direction.

By using a configuration of this type for at least one profile end region, another essential contribution is made to stiffening a framework platform element so that a higher stability is also achieved at a comparatively lower material thickness of the sheet metal material of the framework platform element.

For example, it may be provided that a distance/extension length ratio and/or a ratio of the dimension of the profile end region in a vertical direction to the dimension of the profile end region in the transverse direction lies in the range from 1/3 to 1/2.

To maintain a closed structure of the framework platform element in at least one of the profile end regions, it is proposed that the second profile transverse region lies between the first profile transverse region and the stepping surface region in the vertical direction.

Another contribution to the stiffening of the framework platform element, in particular in one or the two profile end regions, may be provided in that the first profile transverse region connects to the side panel and/or to the profile transition region in a rib-like formation comprising at least one curved shaped region, and/or that the second profile transverse region connects to the profile shaped region in a curved shaped region. It may also be advantageous here that at least one, preferably all of these curved s shaped region s are configured as previously described, thus namely with a radius of curvature smaller than the material thickness of the sheet metal material.

To provide stable and space-saving stacking of multiple framework platform elements on top of one another, it is proposed that a contact region is provided in at least one side panel region of the first profile transverse region, that the transition region connecting this side panel region to the stepping surface region provides a counter contact region, wherein the contact region completely overlaps the counter contact region in the transverse direction. It is possible with this configuration to stack framework platform elements on top of one another without lateral offset.

To achieve additional stabilization, in particular in the profile end region(s), it is proposed that the contact region is delimited in the transverse direction essentially by a rib-like shaped region connecting the first profile transverse region to the side panel region and a rib-like formation connecting the first profile transverse region to the profile transition region.

To facilitate the handling of a framework platform element according to the invention, it is proposed that the rib-like formation connecting the first profile transverse region to the side panel region comprises a first curved shaped region, that the rib-like formation connecting the first profile transverse region to the profile transition region comprises a second curved shaped region, and that a radius of curvature or the first curved shaped region is greater than a radius of curvature of the second curved shaped region.

A uniform contact on another framework platform element may be ensured in that a maximum projection height of the rib-like formation connecting the first profile transverse region to the side panel region above the first profile transverse region corresponds essentially to a maximum projection height of the rib-like formation connecting the first profile rib area to the profile transition region above the first profile transverse region.

It may additionally be provided that the counter contact region comprises at least two rib-like formations of the transition region that extend in the longitudinal direction and are adjacent to one another in the transverse direction.

A reciprocal anchoring of framework platform elements lying on top of one another in the transverse direction of the framework platform elements may, for example, be guaranteed in that a transition region of the rib-like formation connecting the first profile transverse region to the side panel region and an apex region of a rib-like formation of the counter contact region are positioned essentially over one another in the vertical direction.

In a framework constructed using at least one, preferably a plurality of framework platform elements according to the invention, the framework platform elements are generally oriented so that the stepping surfaces provided in the stepping surface region are oriented upward for walking on. This leads to the fact that, in particular during use at a construction side, dirt is accumulated on a framework platform element of this type. To prevent larger accumulations of dirt, in particular in the transition regions to the side panel regions, it is proposed that a depression, formed between two rib-like formations of at least one transition region, has a depression depth, that the rib-like formations forming the depression therebetween have a projection height above the stepping surface, and that the projection height is greater than the depression depth.

The present invention additionally relates to a framework, in particular scaffolding, which is constructed using at least one framework platform element according to the invention. Said framework platform element may be connected to the transverse supports or transverse spars by hanging from above in its two end regions, designed for example like hooks and positioned spaced apart from one another in the longitudinal direction of the framework platform element.

Figure 2:
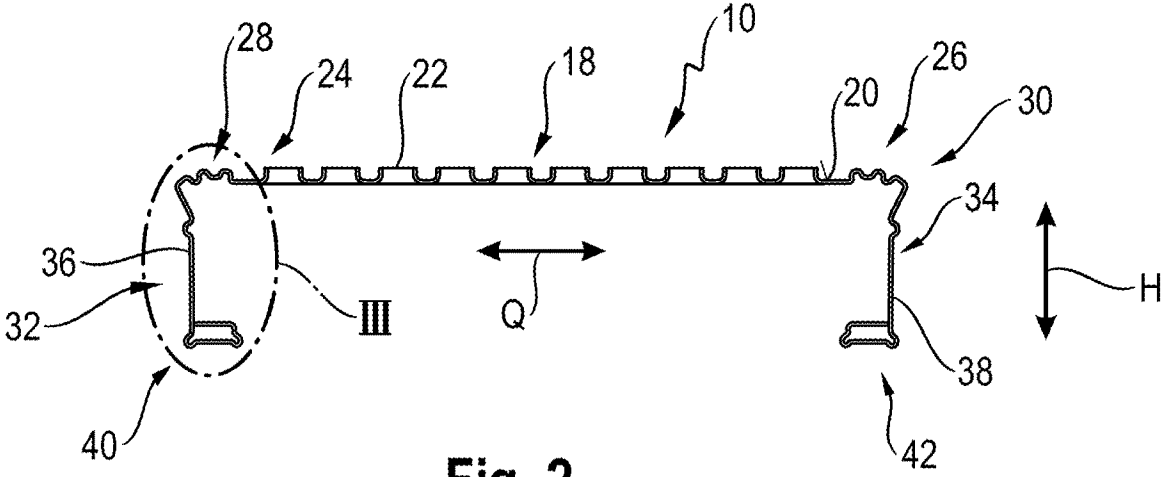
Figure 3:
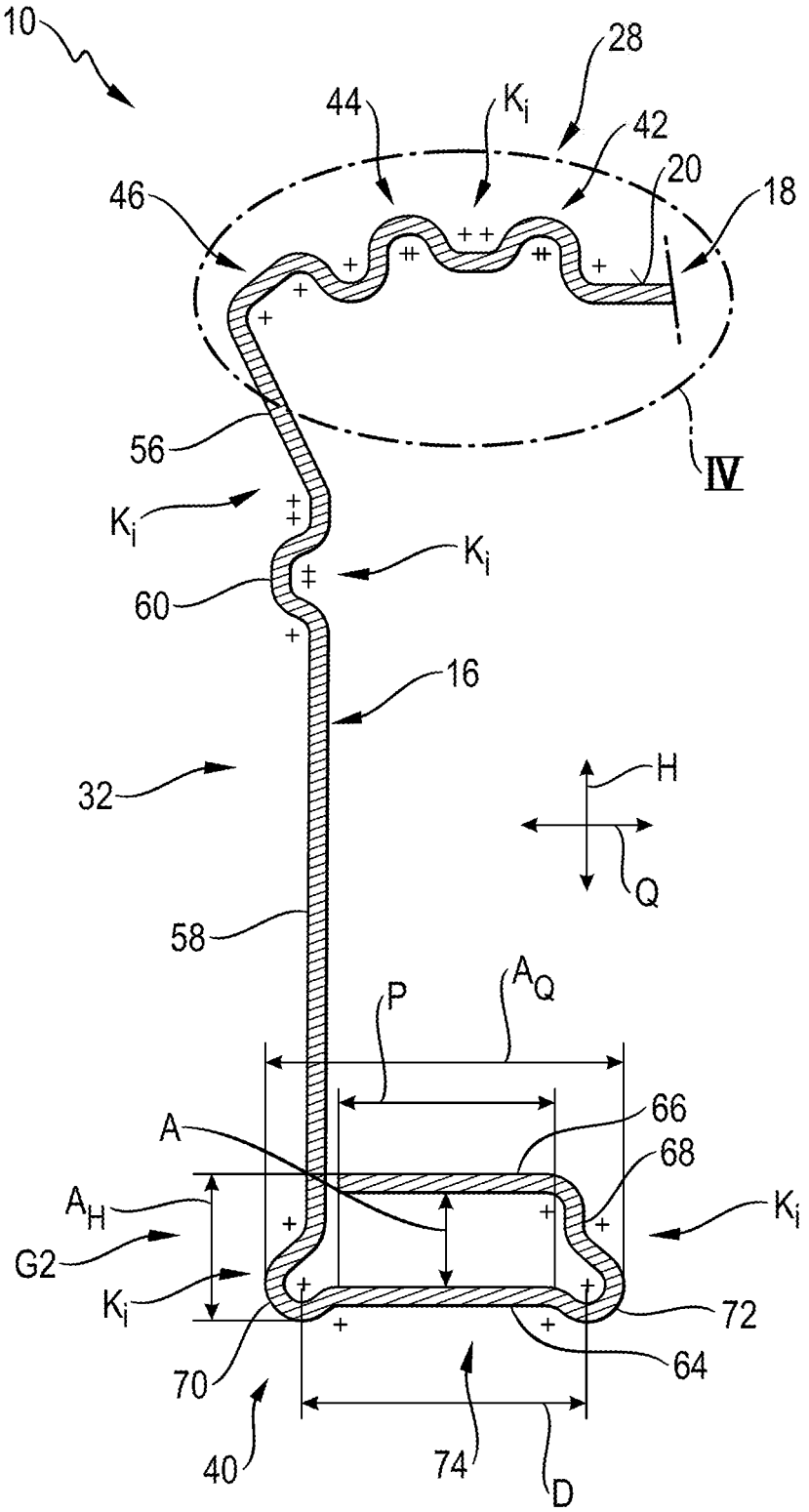
Figure 4:
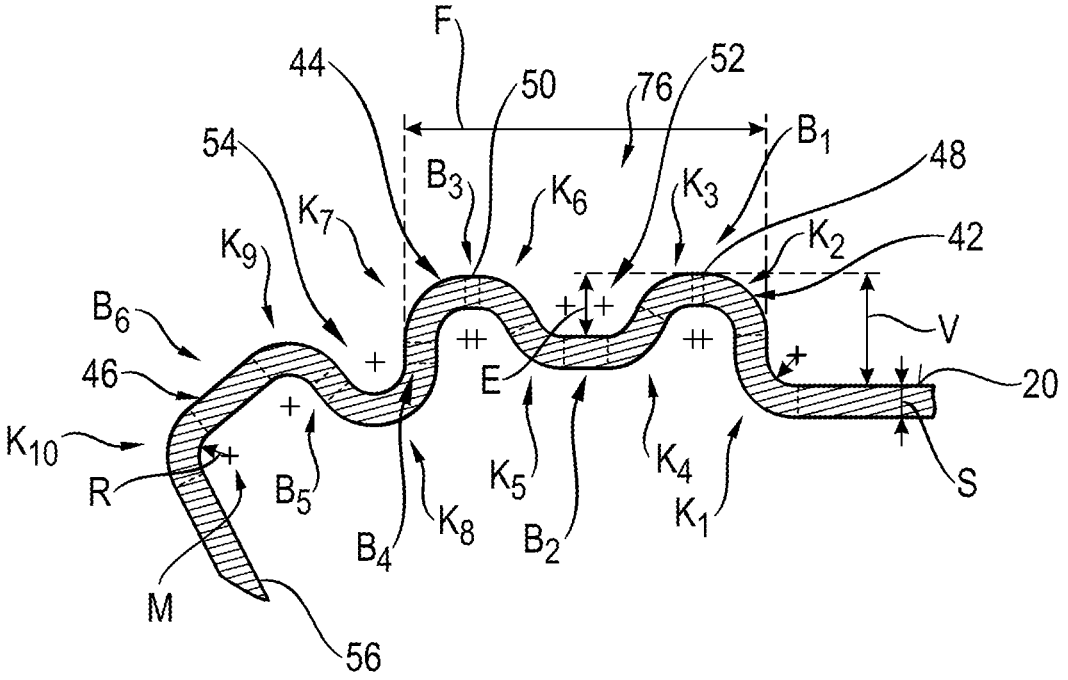
Figure 5:
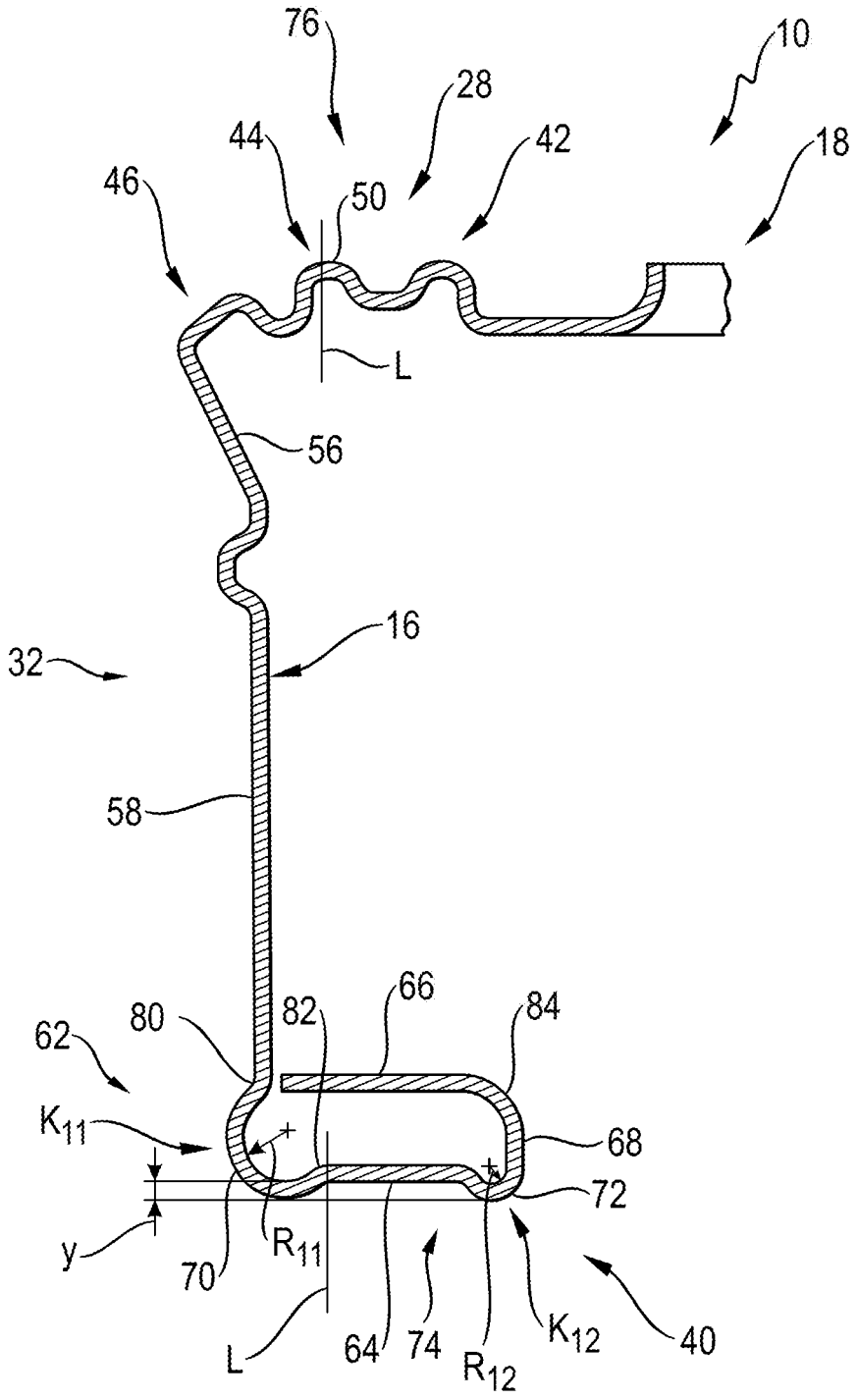

The present invention is subsequently described in detail with respect to the included figures. As shown in:

FIG. 1 a top view of a framework platform element;

FIG. 2 a cross sectional view of the framework platform element from FIG. 1, cut along line II-II in FIG. 1;

FIG. 3 an enlarged view of detail III in FIG. 2;

FIG. 4 an enlarged view of detail IV in FIG. 3;

FIG. 5 a depiction of an alternative configuration of a framework platform element corresponding to FIG. 3.

FIGS. 1 and 2 show a framework platform element 10, usable for constructing a framework, for example scaffolding, in a top view or in a cross sectional view. Framework platform element 10 extends longitudinally in a longitudinal direction L, has thus in a longitudinal direction L a significantly longer dimension than in a transverse direction Q. In its two longitudinal end regions 12, 14, framework platform element 10 may be designed as hook-like for attaching to transverse supports or transverse spars of a framework.

Framework platform element 10 comprises a framework platform body 16 constructed from sheet metal material, wherein, for example, framework platform body 16 may be designed as one piece and may essentially provide the entire framework platform element 10. Framework platform body 16 is formed by shaping a sheet metal blank. Framework platform body 16 provides a stepping surface 20 in a stepping surface region 18 oriented essentially upward by linking framework platform element 10 into a framework. A plurality of stud-like and/or ring-like or slot like formations 22 projecting upward may be formed in the area of said stepping surface 20 in order to increase the stability and the slip resistance on stepping surface 20.

In side panel regions 24, 26 of stepping surface region 18, which are spaced apart from one another in transverse direction Q, transition regions 28, 30 are formed in which stepping surface 18 transitions into respective side panel regions 32, 34. Each side panel region 32, 34 comprises a side panel 36, 38 extending essentially in a vertical direction H and a profile end region 40, 42 in an end region of side panel 36, 38 spaced apart in the vertical direction H from respective transition region 28, 30.

Reference is made to the fact that for the purpose of the present invention, the longitudinal direction L, the transverse direction Q, and the vertical direction H define a coordinate system for framework platform element 10 and may stand, for example, respectively orthogonal to one another. In the use as intended, thus upon linking a framework platform element 10 into a framework, the vertical direction essentially corresponds to a vertical direction so that stepping surface region 18 with its stepping surface 20 lies oriented upward in vertical direction H or in the vertical direction. Insofar as reference is subsequently made to an orientation upward or an orientation downward, this is to be understood in the context of the intended use of linking a framework platform element into a framework.

The construction of framework platform element 10 in its transition regions 28, 30 or side panel regions 32, 34 is subsequently described in particular with reference to FIGS. 3 and 4. Since framework platform element 10 is fundamentally identical in its two side regions with respect to this configuration aspect, it may thus be designed, e.g., mirror symmetrically, reference is subsequently made to the areas depicted on the left in FIG. 2, thus transition region 28 and side panel region 32. Statements on this matter apply equally to the formations lying on the other side. However, reference is also made to the fact that framework platform element 10 may also be basically configured with non-identical transition regions or side panel regions in its two side areas.

It is clear in FIGS. 3 and 4 that transition region 28 has a plurality of rib-like formations 42, 44, 46 extending preferably across essentially the entire length of framework platform body 16 in longitudinal direction L. The two rib-like formations 42, 44 lying adjacent to one another in transverse direction Q connecting to side panel region 24 of stepping surface region 18 respectively have apex regions 48, 50, which have a projection height V in the vertical direction H relative to stepping surface 20 of stepping surface region 18. A depression 52 is formed between these two rib-like formations 42, 44 that has a depression depth E relative to apex regions 48, 50. Depression depth E is less than projection height V so that the accumulation of contaminants in transition region 28 may be reduced. A depression 54, formed between rib-like formations 44, 46 lying outwardly adjacent to one another, may have a depression depth that is less than projection height V, for example, it may like in the range of depression depth E of depression 52.

Rib-like formations 42, 44, 46 are formed by shaping a sheet metal blank to provide framework platform body 16. During this shaping, curved shaped regions $K_1$ to $K_{10}$, subsequently generally labeled $K_i$, are formed. At least one or some, preferably all of these curved shaped regions $K_i$ are defined by a radius of curvature R with respect to a center of curvature M, designated in each case by a "+" and which is not greater than the material thickness S of the sheet metal material used for constructing framework platform body 16.

By providing curved shaped regions $K_i$ with this type of small radius of curvature R, a comparatively large deformation of the sheet metal material is generated so that the offsets generated thereby are anchored in the lattice structure of the sheet metal material and lead to a substantial stiffening of framework platform body 16. At the same time, a material accumulation is generated in transition region 24 by the provision of curved shaped regions $K_i$ and rib-like formations 42, 44, 46 generated thereby, which likewise contributes to the increased stability. This allows, for example, for the use of a sheet metal material for the construction of framework platform body 16, that has a material thickness S in the range of 1.3 mm. This means that, in a framework platform element 10 constructed in this way, that radius of curvature R is not greater than 1.3 mm in the various curved shaped regions $K_i$.

Each of rib-like formations 42, 44, 46 is provided by a plurality of this type of curved shaped regions $K_i$. Thus, for example, rib-like formation 42, which connects directly to stepping surface region 18 or stepping surface 20, comprises four curved shaped regions $K_1$, $K_2$, $K_3$, $K_4$. These may each have in their sequence different curve orientations, which, for example, is the case for curved shaped regions $K_1$ and $K_2$ and for curved shaped regions $K_3$ and $K_4$. Curve-like shaped regions $K_2$ and $K_3$, which follow in sequence, have an identical curve orientation to one another. In a corresponding way, rib-like formation 44 is essentially provided by curved shaped regions $K_5$, $K_6$, $K_7$, and $K_8$, while rib-like formation 46 is provided by curved shaped regions $K_8$, $K_9$, and $K_{10}$.

In the case of two rib-like formations 42, 44, the respective apex regions 48, 50 lie in the area of essentially uncurved connecting regions $B_1$ or $B_3$ which respectively connect two curved shaped regions $K_2$, $K_3$ or $K_6$, and $K_7$. This leads to the fact that the center points of the curve of curved shaped region $K_2$, $K_3$, or $K_6$, 7 assigned to a respective rib-like formation 42, 44 are likewise positioned at a distance to one another, are positioned in particular in the depicted example at a distance in transverse direction Q; however, are positioned essentially at the same level in vertical direction H. An essentially uncurved connecting region $B_2$ is positioned between two rib-like formations 42, 44 or between curved formation areas $K_4$, $K_5$ respectively assigned thereto. Rib-like formation area 46 also has an essentially uncurved connecting region $B_6$ between two curved formation areas $K_9$ and $K_{10}$. Connecting region $B_6$ is longer than connecting regions $B_1$ and $B_3$ so that a comparatively large contact region is formed at rib-like formation area 46, in particular by connecting region $B_6$ in conjunction with the laterally delimiting curved shaped regions $K_9$ and $K_{10}$, and a clamping strap is guided via said contact area for fixing framework platform element 10, for example together with other framework platform elements, on a transport vehicle or a transport pallet. In this way, a point or linear interaction between a clamping strap and framework platform element 10 leading to a load on framework platform element 10 that is too large is prevented.

Side panel 36 of side panel region 32 connects at transition region 28 to a side panel section 56 of side panel 36 extending downward in vertical direction H from rib-like formation area 46 or curved shaped region $K_{10}$, thus toward profile end region 40, and inward in transverse direction Q, thus toward the other side panel region 34. In the lower end region of said side panel section 56, it connects to a side panel section 58 extending essentially in vertical direction H, thus essentially orthogonal to transverse direction Q and to longitudinal direction L. An outwardly formed rib-like formation 60, thus in the direction away from the other side panel region 34, is formed in side panel section 58 close to the adjoining area of the two side panel sections 58, 56 to one another. This rib-like formation 60 is also provided using multiple curved shaped regions $K_i$. The transition from side panel section 56 to side panel section 58 is likewise provided by one or multiple curved shaped regions $K_i$. At least one, preferably all of these curved shaped regions $K_i$ again satisfy the condition that their radius of curvature is not greater than material thickness S of the sheet metal material of framework platform body 16. This also contributes, in particular in the area of side panel region 32 or side panel region 36, to a stiffening of the same.

In profile end region 40, formed on end region 62 of side wall area 32 and situated at a distance from transition region 28, framework platform body 16 is designed with two profile transverse areas 64, 66, which extend preferably essentially parallel to one another and preferably in transverse direction Q, and are connected to one another in a profile transition region 68. First profile transverse area 64 connects to side panel 36, in particular to side wall section 58 extending essentially in vertical direction H, in the area of an outward slanting rib-like formation 70 on side wall 36, thus slanting essentially away from the other side panel region 34 and away from stepping surface region 18. Profile transition region 68 connects to first profile transverse section 64 in the area of another downward slanted rib-like formation 72 slanting essentially toward the other side panel region 34 and in the direction away from stepping surface region 18. These rib-like formations 70, 72 likewise respectively comprise a plurality of curved shaped regions $K_i$, wherein here as well at least one, or some, preferably all curved shaped regions $K_i$ may satisfy the condition that their respective radius of curvature is not greater than material thickness S of the sheet metal material of framework platform body 16.

This correspondingly also applies for a curved formation region, in which second profile transverse area 66 connects to profile transition region 68.

Profile end region 40 is configured or dimensioned in end region 62 of side panel region 32 in such a way that its dimension $A_H$ is smaller in vertical direction H than its dimension $A_Q$ is in transverse direction Q. This is achieved in particular in that a respective extension length P of first profile transverse area 64 or of second profile transverse area 66 is greater in transverse direction Q than its distance A in vertical direction H. Two profile transverse areas 64, 66 may thereby have, for example, the same extension length P in transverse direction Q and be situated completely overlapping one another in transverse direction Q. Second profile transverse area 66 thereby ends in its end region spaced apart from profile transition region 68 in transverse direction Q at a small distance from side panel section 58 of side panel 36.

Another contribution to the stiffening of framework platform element 10 is achieved by the dimensioning of profile end region 40, which is clear in FIG. 3, and in which a ratio of dimension $A_H$ in the vertical direction to dimension $A_Q$ in the transverse direction or a ratio of the distance A to extension length P may lie in the range from 1/3 to 1/2. This aspect of the stiffening is particularly advantageous in and of itself; however, in conjunction with the configuration of transition region 24, described earlier with reference to FIG. 4, and/or the configuration of side panel region 32, it leads to very stable and thus high loadable framework platform element when using a comparatively thin sheet metal material.

Profile end region 40 forms a contact region 74, in particular with its first profile transverse area 64 and the two rib-like formations 70, 72 delimiting said first profile transverse area in transverse direction Q. Said contact region extends in transverse direction Q, for example, at an extension length D, which is, for example, measured between the downward oriented apex regions of rib-like formations 70, 72. In transition region 28, which is situated in vertical direction H over profile end region 40, the two rib-like formations 42, 44 form a counter contact region 76. This may have an extension length F in transverse direction Q, which is measured, for example, between flank areas of rib-like formations 42, 44 situated facing away from one another.

When stacking multiple framework platform elements 10 on top of one another, an upper of two framework platform elements 10 may be positioned with its contact region 74 provided in the area of two side panel regions 32, 34 on top of counter contact regions 76 provided in transition regions 28, 30 of a lower of the two framework platform elements 10 such that two rib-like formations 42, 44 are positioned in transverse direction Q between two rib-like formations 70, 72, even through the two framework platform elements 10 are positioned without offset in transverse direction Q, thus completely overlapping one another. Since in this arrangement of framework platform elements 10, two rib-like formations 42, 44 are accommodated in transverse direction Q between rib-like formations 70, 72, a lateral sliding off of the upper of the two framework platform elements from lower framework platform element 10 is simultaneously prevented. In this way, a space-saving, stable stackability of the framework platform elements is guaranteed. In this stacked state, multiple framework platform elements of this type may then be clamped to one another or to a transport vehicle, a transport pallet, or the like in the previously described way by one or more encompassing clamping belts.

One alternative configuration of a framework platform element 10 is depicted in FIG. 5. Reference is also made here to the fact that FIG. 5 shows only one of two side panel regions 32, 34 of framework platform element 10. The side panel region not shown in FIG. 5 is preferably configured mirror-symmetrically to side panel region 32, depicted in FIG. 5, with respect to a plane of symmetry extending in vertical direction H. Framework platform element 10 from FIG. 5 differs from the framework platform element described in detail with reference to FIGS. 3 and 4 essentially in the configuration of profile end region 40. Therefore, essentially the differences from the previously described embodiment are addressed in this profile end region 40. Reference is made to previous statements with respect to the configuration of framework platform element 10 in its other areas.

In profile end region 40 in the embodiment depicted in FIG. 5, first profile end region 64, which extends essentially in the horizontal direction toward the not-shown side panel region, contacts between two rib-like formations 70, 72 situated spaced apart from one another in transverse direction Q. Each of these two rib-like formations 70, 72 is formed, for example, by a curved shaped region $K_{11}$ or $K_{12}$. A radius of curvature $R_{11}$, which describes or defines preferably essentially the course of entire first curved transition region $K_{11}$ which connects first profile transverse area 64 to side panel section 58, is greater than a radius of curvature $R_{12}$ of second curved transition region $K_{12}$, which connects first profile transverse area 64 to profile transition region 68. Nevertheless, two curved transition regions $K_{11}$, $K_{12}$ essentially have the same maximum projection height Y downward past first profile transverse area 64. This leads to the fact that, in comparison to the embodiment depicted in FIG. 3, a transition region 80 of rib-like formation 70 is displaced further upward to side panel section 58, and is situated, for example, in vertical direction H essentially in the range of second profile transverse area 66.

Due to the configuration of first curved transition region $K_{11}$ with a larger radius of curvature, a transition region 82, in which this or rib-like formation 70 transitions into first profile transverse area 64, is displaced farther inward in transverse direction Q, thus away from side panel section 58 or toward other side panel region 34. Based on a reference line L, depicted in FIG. 5 and extending essentially in vertical direction H, it is clear that this transition region 82 is positioned in transverse direction Q approximately at the point, where apex region 50 of rib-like formation 44 of counter contact region 76 is also situated. Said rib-like formation 44 is that rib-like formation of counter contact region 76 which is positioned farthest outward in transverse direction Q, thus spaced the farthest from the other side panel region. When stacking multiple framework platform elements 10 on top of one another, such an apex region 50 in contact region 74 comes to be positioned approximately where transition region 82 is positioned. Said transition region 82 thus surrounds apex region 50 in sections. Since this is carried out in the area of the two side panel regions 32, 34, then the two framework platform elements 10 situated on top of one another are anchored in transverse direction Q by a positive engagement against displacement with respect to one another.

Another difference, which is advantageous for reasons of simpler manufacturing, in comparison to the configuration according to FIG. 3, is clear in a transition region 84, in which second profile transverse area 66 transitions into profile transition region 68. This is provided in the embodiment from FIG. 5 by a single curved transition region formed, for example, by a constant radius of curvature.

The invention claimed is:

1. A framework platform element, in particular for scaffolding, comprising a framework platform body made from sheet metal material and extending in a longitudinal direction, with a stepping surface region providing a stepping surface on a top side and with two side panel regions, each one of the two side panel regions connecting to the stepping surface region in a respective transition region, each one of the two transition regions being formed by shaping a sheet metal blank in two edge regions of the stepping surface region that are situated at a distance from one another in a transverse direction, wherein each one of the two side panel regions has a side panel extending in a vertical direction and a profile end region, formed by shaping the sheet metal blank, in an end region spaced apart from the transition region in the vertical direction, wherein in each one of the two transition regions and in each one end of the profile end regions, at least one curved shaped region formed by shaping the sheet metal blank is provided, wherein in each one of the two side panel regions, the profile end region comprises a first profile transverse area extending from the side panel of the respective side panel region to the other side panel region and a second profile transverse area extending from a profile transition region to the side panel of the respective side panel region and connected by the profile transition region to the first profile transverse area, wherein a distance of the first profile transverse area to the second profile transverse area is smaller in the vertical direction than an extension length of the first profile transverse area and/or an extension length of the second profile transverse area in the transverse direction, and/or wherein a dimension of the profile end region is greater in the transverse direction then a dimension of the profile end region in the vertical direction, wherein each one of the two first profile transverse areas connects to the side panel of the respective side panel region and to the profile transition region in a rib-like formation with the at least one curved shaped region, wherein in each one of the two side panel regions, the first profile transverse area provides a contact region, and the transition region connecting the respective side panel region to the stepping surface region provides a counter contact region, wherein the contact region completely overlaps the counter contact region in the transverse direction, wherein each one of the two contact regions is delimited in the transverse direction by the rib-like formation connecting one of the two first profile transverse areas to the side panel of the respective side panel region and by a rib-like formation connecting the first profile transverse area to the profile transition region, wherein each one of the two counter contact regions comprises at least two rib-like formations of the transition region connecting one of the two side panel regions to the stepping surface region that extend in the longitudinal direction and are situated adjacent to one another in the transverse direction, at least one of the rib-like formations of the counter contact region comprising two curved shaped regions separated from one another by an uncurved connecting region, an apex region of this at least one the rib-like formation of the counter contact region being provided in the area of the uncurved connecting region, wherein, in each one of the two transition regions, the at least two rib-like formations of the counter contact region in the transverse direction being positioned between the rib-like formation connecting one of the two profile transverse areas to the side panel of the respective side panel region and the rib-like formation connecting the first profile transverse area to the profile transition region, wherein each one of the two transition region comprises a further rib-like formation positioned outside of the counter contact region in the transverse direction and in a direction away from the other one of the two transition regions, each one of the further rib-like formations providing a connection to one of the two side panel regions, each one of the two side panel regions comprising a first side panel section extending downward in the vertical direction from one of the further rib-like formations and inward in the transverse direction to the other side panel region, and comprising a second side panel section extending downward in the vertical direction and orthogonal to the transverse direction, a rib-like formation being provided in each one of the two second side panel sections close to the adjoining areas of the first and second side panel sections.

2. The framework platform element according to claim 1, wherein a material thickness of the sheet metal blank is between 1.0-1.5 mm, and/or that the at least one curved shaped region extends in the longitudinal direction uninterrupted across the entire length of the framework platform body.

3. The framework platform element according to claim 1, wherein in the at least one side panel region a rib-like formation with at least one curved shaped region is provided between the transition region and the profile end region extending in the longitudinal direction across the entire length of the framework platform body.

4. The framework platform element according to claim 1, wherein a radius of curvature is less than or equal to a material thickness of the sheet metal blank in at least sections in at least one curved shaped region.

5. The framework platform element according to claim 1, wherein a spacing/extension ratio and/or a ratio of the dimension of the profile end region in the vertical direction to the dimension of the profile end region in the transverse direction is from 1/3 to 1/2.

6. The framework platform element according to claim 1 wherein, the second profile transverse area is situated in the vertical direction between the first profile transverse area and the stepping surface region.

7. The framework platform element according to claim 1, wherein the second profile transverse area connects to the profile transition region in a curved transition region.

8. The framework platform element according to claim 1, wherein the rib-like formation connecting the first profile transverse area to the side panel region comprises a first curved shaped region, the rib-like formation connecting the first profile transverse area to the profile transition region comprises a second curved shaped region, and a radius of curvature of the first curved shaped region is greater than a radius of curvature of the second curved shaped region.

9. The framework platform element according to claim 8, wherein a maximum projection height of the rib-like formation connecting the first profile transverse area to the side panel region above the first profile transverse area corresponds to a maximum projection height of the rib-like formation connecting the first profile transverse area to the profile transition region above the first profile transverse area.

10. The framework platform element according to claim 1, wherein a transition region of the rib-like formation connecting the first profile transverse area to the side panel region and an apex region of one of the rib-like formations of the counter contact region are positioned above one another in the vertical direction.

11. The framework platform element according to claim 1, wherein a depression formed between two rib-like formations of the at least one transition region has a depression depth, wherein the rib-like formations forming the depression there between have a projection height above the stepping surface, and that the projection height is greater than the depression depth.

12. Framework, in particularly scaffolding, comprising at least on framework platform element according to claim 1.

13. The framework platform element according to claim 1, wherein, in each one of the two transition regions, the apex regions of the at least two rib-like formations of the counter contact region are at a same level in the vertical direction and the further rib-like formation is offset with respect to the apex regions of the at least two rib-like formations of the counter contact region downward in the vertical direction.

14. The framework platform element according to claim 1, wherein, in each one of the two transition regions, the further rib-like formation comprises two curved shaped regions separated from one another by an uncurved connecting region, the uncurved connecting region being inclined with respect to the vertical direction such as to extend downward in the vertical direction and in the transverse direction away from the other transition region.

15. The framework platform element according to claim 14, wherein, in each one of the two transition regions, the uncurved connecting region of the further rib-like formation is longer than the uncurved connecting region of the at least one of the rib-like formations of the counter contact region.

* * * * *